US006032809A

United States Patent [19]

Irsch

[11] Patent Number: 6,032,809

[45] Date of Patent: Mar. 7, 2000

[54] APPARATUS FOR REDUCING THE AXLE LOAD OF A MULTIAXLE MOVABLE TELESCOPIC CRANE

[75] Inventor: Michael Irsch, Lebach, Germany

[73] Assignee: Mannesmann AG, Düsseldorf, Germany

[21] Appl. No.: 09/079,732

[22] Filed: May 15, 1998

[30] Foreign Application Priority Data

May 16, 1997 [DE] Germany ..... 197 21 865

[51] Int. Cl.[7] ..... B66C 23/26

[52] U.S. Cl. ..... 212/181; 212/299

[58] Field of Search ..... 280/404, 423.1; 52/120; 296/181; 212/180, 181, 299, 300, 301, 177, 175

[56] References Cited

U.S. PATENT DOCUMENTS

| | | | |
|---|---|---|---|
| 1,949,156 | 2/1934 | Francis et al. | 280/423.1 |
| 2,857,993 | 10/1958 | Terrell | 52/120 |
| 3,058,311 | 10/1962 | Woolslayer et al. | 52/120 |
| 3,136,394 | 6/1964 | Woolslayer et al. | 52/120 |
| 3,154,207 | 10/1964 | Long | 410/44 |
| 3,224,597 | 12/1965 | Whitmire | 280/404 |
| 3,954,193 | 5/1976 | Whittingham | 212/180 |
| 4,565,291 | 1/1986 | Khirwadkar | 212/180 |
| 4,660,731 | 4/1987 | Becker | 212/180 |

FOREIGN PATENT DOCUMENTS

| | | | |
|---|---|---|---|
| 3339562 | 5/1985 | Germany | 212/299 |
| 580998 | 11/1977 | U.S.S.R. | 280/404 |

*Primary Examiner*—Thomas J. Brahan

*Attorney, Agent, or Firm*—Cohen, Pontani, Lieberman & Pavane

[57] ABSTRACT

An apparatus for reducing the axle load of a multiaxle movable crane which includes a truck; a superstructure rotatably mounted on the truck; a main jib including a basic jib and at least one telescopic section, the basic jib having a plurality of rollers fastened in operative connection, the main jib being releasably fastened to the superstructure; and a semitrailer having a front end and a back end with a loading area, a first ramp-like beam and a second ramp-like beam arranged in a longitudinal direction of the semitrailer in the loading area so as to be parallel to and at a distance from one another, each ramp-like beam having a top edge and a contoured runway disposed along the top edge, the rollers being configured to the contour of the runway and operable to transport the main jib from the superstructure to the semitrailer.

12 Claims, 4 Drawing Sheets

APPARATUS FOR REDUCING THE AXLE LOAD OF A MULTIAXLE MOVABLE TELESCOPIC CRANE

BACKGROUND OF THE INVENTION

1. Field of the Invention

The invention relates to an apparatus for reducing the axle load of a multiaxle movable telescopic crane.

2. Discussion of the Prior Art

The users of movable telescopic cranes increasingly require higher carrying loads which leads to an increase in the number of axles and/or to an increase in the axle load itself. Limits are placed on both of these, however, since too large a number of axles does not ensure the necessary curve negotiating characteristic and too high an axle load exceeds the permissible axle load for road transport. National governments have issued different regulations in this respect.

One possibility of solving the problem is to separate the main jib of considerable weight from the remaining vehicle crane and load the jib onto a separate low loader. In this case, the dismounting and mounting of the main jib are to take place quickly and, if possible, with simple aids.

U.S. Pat. No. 3,954,193 discloses an arrangement which makes it possible to separate the main jib from the vehicle crane and displace the jib by rolling it on a semitrailer designed as a low loader. For this purpose, a wagon, which is movable on rails and onto which the main jib can be deposited, is arranged on the semitrailer. The rear part of the wagon is designed as a lifting platform, so that the main jib can be lifted out of the vehicle crane. After the main jib has been separated from the vehicle crane, the wagon is displaced by means of a cylinder into the foremost position of the semitrailer and is locked in this position. The various cylinders arranged on the semitrailer are supplied hydraulically from the vehicle crane via a couplable connecting line.

A disadvantage of this arrangement is that it is necessary to mount on the semitrailer a wagon of complicated design. Moreover, the hydraulic supply of the cylinders of the semitrailer, is dependent on the vehicle crane.

SUMMARY OF THE INVENTION

It is an object of the invention to provide a apparatus for reducing the axle load of a multiaxle movable telescopic crane, the apparatus implementing only a few elements of simple design which are to be mounted on the semitrailer and which themselves do not require any connection to the hydraulic system of the vehicle crane.

According to the invention, there are arranged on the loading area of the semitrailer two ramp-like beams which are located parallel to and at a distance from one another in the direction of the longitudinal axis of the semitrailer and which, on the top edge, are provided with a runway. Rollers adapted to the contour of the runway are fastened in operative connection to the basic jib. Preferably, the runway is designed as an upwardly open U-profile. The roller is arranged on a pair of web plates angled in the transverse direction of the basic jib and fastened to the side wall of the basic jib. To transfer the main jib from the vehicle crane onto the semitrailer, the beam has a fixed element and a movable element. For example, the movable element may be pivotable. The pivot axis lies perpendicularly to the loading area and is located in the end region of the semitrailer. During rolling, the movable element is in the extension of the fixed element and, after dismounting, in the transport phase is parallel to the fixed element. In this way, the maximum allowable length of the semitrailer during road transport is not exceeded. For the previously explained raising and lowering of the main jib, both the movable element and the fixed element of the beam have an obliquely descending portion.

The operating mode which results from this arrangement is the simplest possible. The partially extended main jib is deposited with its roller head onto the semitrailer receiving part arranged on the saddle of the -semitrailer. For adjustment, this receiving part is designed so as to be laterally displaceable and angularly movable. After the main jib has been unlocked, the basic jib is retracted somewhat, and the basic jib can roll, and at the same time be guided, via rollers arranged at the rear end of the basic jib, in cooperation with rails arranged on the superstructure. In the case of further retraction, the rollers arranged in the middle region of the basic jib support the basic jib on the semitrailer and lift the basic jib out of the guide of the superstructure. During further retraction, the basic jib is drawn completely out of the superstructure and consequently, as far as is necessary, lowers the telescoping main jib into the transport position. The pivotable elements of the beam are folded up and secured to the fixed element. After the main jib has been appropriately wedged and lashed firmly on the semitrailer, the latter can drive off to the place of use.

Dispensing with a complicated lifting device saves costs and reduces the dismounting time, since, apart from arranging the beams on the semitrailer, there is no need for any further aids.

BRIEF DESCRIPTION OF THE DRAWINGS

Various embodiments of the present invention are described and illustrated herein with reference to the drawings in which like items are indicated by the same reference designation, in which.

DETAILED DESCRIPTION OF THE PRESENTLY PREFERRED EMBODIMENTS

Figure 1A:
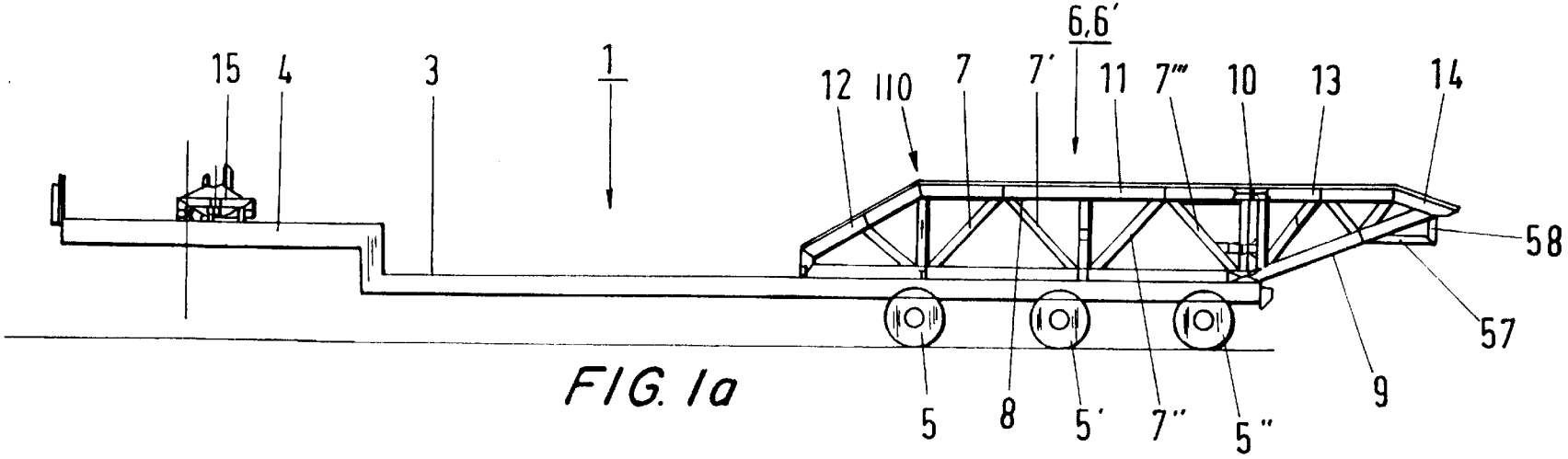
FIG. 1*a* shows a side view of a semitrailer equipped with an apparatus for reducing the axle load of a multiaxle movable telescopic crane in accordance with the present invention.
Figure 1B:
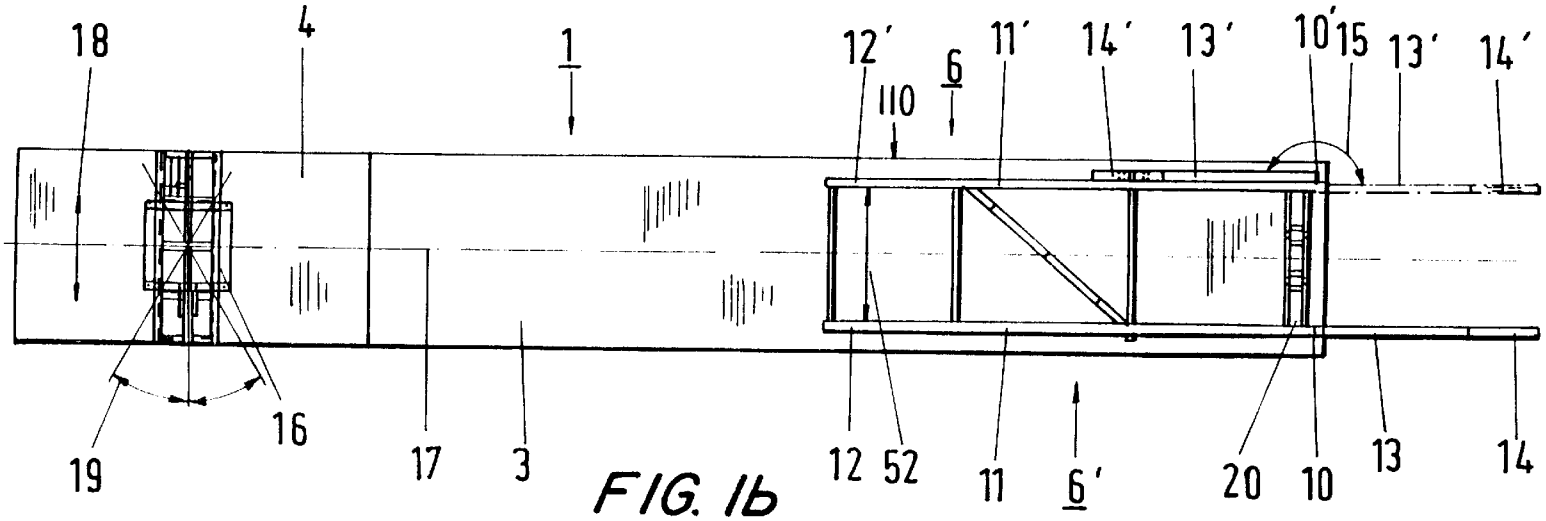
FIG. 1*b* is a top view of FIG. 1*a;*

Referring to the drawings, FIGS. 1*a* and 1*b* illustrate a longitudinal view and a top view of a semitrailer 1 equipped according to the invention and designed as a low loader. An illustration of the semitrailer tractor 2 (FIGS. 5*a–e*) has been dispensed with here. In this embodiment, the semitrailer 1 is a six-wheeler and has a loading area 3 and a saddle 4. An illustration of the connecting element, arranged on the saddle 4, for coupling the semitrailer 1 to the semitrailer tractor 2 has been dispensed with here.

According to the invention, a beam assembly 110 comprises two ramp-like beams 6, 6' that are parallel to and at a distance 52 from one another and are arranged on that part of the loading area 3 which is located in the region of the axles 5, 5', 5". The beam assembly 110 has struts 7, 7', 7", 7'" which are incorporated for reinforcing the beams 6, 6'. Each beam 6, 6' has a fixed element 8, 8' and a pivotable element 9, 9'. The pivot axis 10, 10' lies in the end region of the loading area 3 of the semitrailer 1. Starting from the pivot axis 10, 10', the fixed element 8, 8' has a horizontally lying portion 11, 11' which an obliquely descending portion 12, 12' adjoins. In a comparable way, starting from the pivot axis 10, 10', the pivotable element 9, 9' has a horizontally lying portion 13, 13' which an obliquely descending portion 14, 14' adjoins. The pivotable element 9', illustrated by broken lines in FIG. 1*b*, shows the pivoting possibility, here indicated by a pivoting arrow 15. The pivotable element 9, 9' may be arranged in the extension of the fixed element 8, 8', or so as to lie parallel to the fixed element 8, 8'. To preserve the distance 52 between the two beams 6, 6' and for further reinforcement, a transverse web 20 may be arranged in the pivoting end region of the loading area 3.

A semitrailer receiving part 16 to receive the roller head 49 of the main jib 21 is arranged on the saddle 4 of the semitrailer 1. For adjustment, this semitrailer receiving part 16 is displaceable transversely to the longitudinal axis 17 of the semitrailer 1, here identified by a double arrow 18. The semitrailer receiving part 16 is also arranged so as to be angularly movable, as shown by the pivoting arrow 19.

Figure 2A:
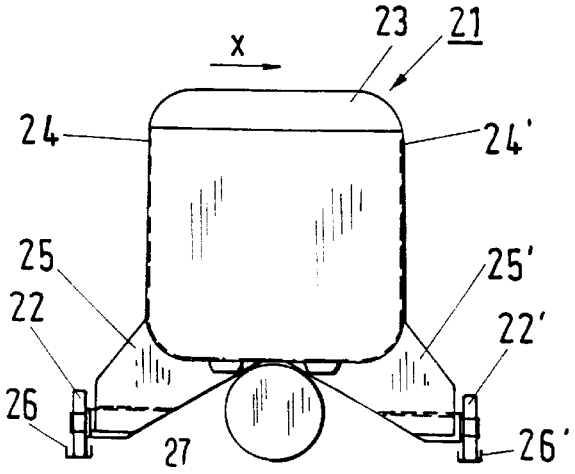
FIG. 2*a* is a cross sectional view of a main jib designed according to the invention, in the plane of the rollers.
Figure 2B:
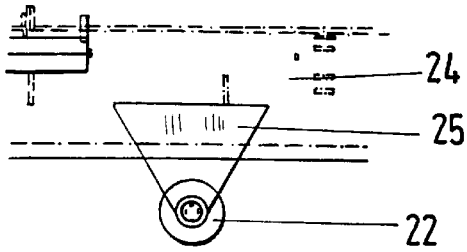
FIG. 2*b* is a view of a portion of the main jib in the direction X of FIG. 2*a;*

FIG. 2*a* shows, in cross section, a main jib 21 in the plane of the rollers 22, 22' provided according to the invention, and FIG. 2*b* shows a view in the direction X of FIG. 2*a*. To simplify the illustration, the telescopic sections capable of being pushed into the basic jib 23 have been dispensed with. To fasten the rollers 22, 22', angled web plates 25, 25' are fastened in the region of the side wall 24, 24' of the basic jib 23. The rollers 22, 22' run in U-profiles 26, 26' which are arranged along the top edge of the beams 6, 6' (FIGS. 1*a* and 1*b*). The luffing cylinder 27, which, in this embodiment, is arranged centrally below the main jib 21, can also be seen in this illustration.

Figure 3A:
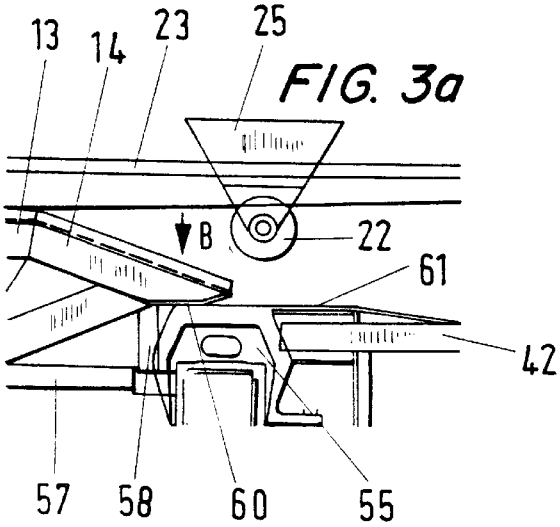
FIG. 3*a* illustrates the details for centering the semitrailer in relation to the truck of the telescopic crane.
Figure 3B:
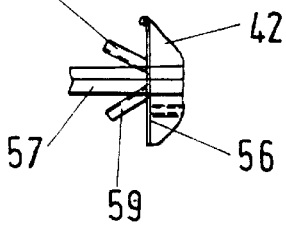
FIG. 3*b* is a detail view in the direction B of FIG. 3*a;*

FIGS. 3*a* and 3*b* illustrate the details for centering the semitrailer 1 in relation to the truck 42 of the telescopic crane 40. A guide part comprising in each case two struts 57, 58 is arranged on the underside of the obliquely descending portion 14, 14' of the beam 6, 6' arranged on the semitrailer 1. The truck receiving part necessary for centering is fastened, in the form of a fork 59, 59', in the bumper region 56 of the truck 42. This ensures that, when the semitrailer 1 is driven up to the telescopic crane 40, the respective guide part of the beam 6, 6' can then engage in a centering manner into the respective truck receiving part of the truck 42. So that the pivotable element 9, 9' of the beam 6, 6' (FIGS. 1*a* and 1*b*) is not subjected to too high a load as a cantilever beam during the takeover of the main jib 21, the lower edge region 60 of the obliquely descending portion 14, 14' lies on the top edge 61 of the truck 42 and can be supported on the latter. The truck 42 is supported in this region by the raisable and lowerable ground support 55 arranged in the bumper region.

Figure 4A:
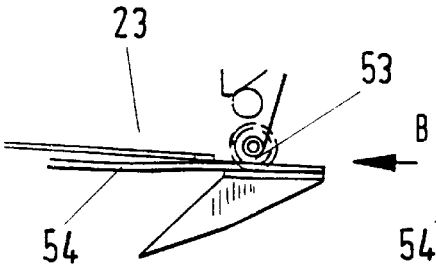
FIG. 4*a* is a detail view of the guide in the superstructure.
Figure 4B:
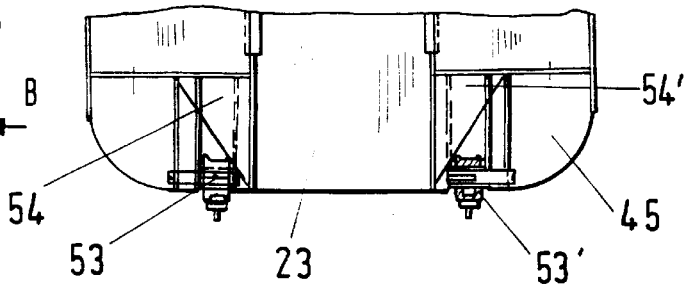
FIG. 4*b* is a view of the guide in the direction B of FIG. 4*a;*
Figures 5A, 5B, 5C:
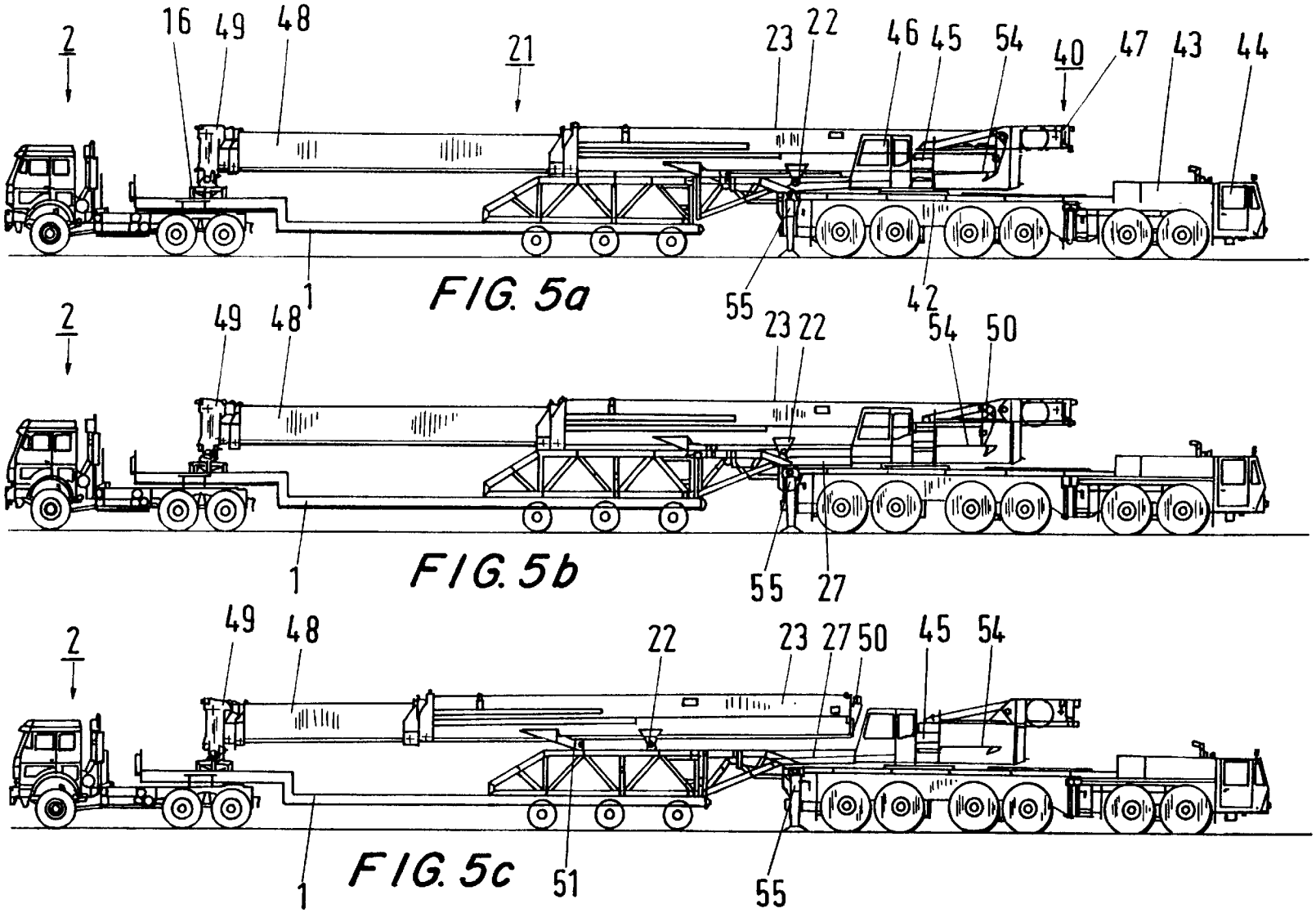
FIG. 5*a* shows one phase of dismounting a main jib from a telescopic crane and shows the partly telescoped main jib pivoted to the left and deposited on the semitrailer.
FIG. 5*b* shows a phase of dismounting the main jib from the telescopic crane wherein the basic jib is retracted slightly to the left.
FIG. 5*c* shows a phase of dismounting the main jib from the telescopic crane wherein the basic jib is further retracted.

FIGS. 4*a* and 4*b* illustrate the guide and are further referred to below in connection with FIG. 5*a*. FIGS. 5*a–e* illustrate, in a longitudinal view, the five essential phases of the dismounting of a main jib from a telescopic crane 40, the dismounting being carried out to according to the invention. On the right side of FIGS. 5*a–e*, a movable multiaxle telescopic crane 40 is positioned with a forward direction of travel being to the right. The essential structural elements of this telescopic crane 40 are a truck 42 which, in this embodiment, is provided with six axles, a main engine 43 and a driver's cab 44. Mounted rotatably on the truck 42 is a superstructure 45 which has a crane cab 46 and a cable or rope winch assembly 47. Fastened to the superstructure 45 is the already mentioned main jib 21 which has a basic jib 23 and a plurality of telescopic sections, only one pushed-out telescopic section 48 being visible in this illustration for simplification. The main jib 21 carries a roller head 49 on the head side. The basic jib 23 is releasably connected at its footpiece 50 directly to the superstructure 45 and, on the underside, to the already mentioned luffing cylinder 27 by means of a hook.

On the left side of the FIGS. 5*a–e*, the already mentioned semitrailer 1 is positioned in front of the telescopic crane 40 so as to have a forward direction of travel to the left, without any appreciable vertical and lateral offset. Reference is made to the description of FIGS. 3*a* and 3*b* for the positioning details. The semitrailer vehicle comprises the already mentioned semitrailer 1 and the semitrailer tractor 2. Reference is made to the description of FIGS. 1*a* and 1*b* for the details of the semitrailer 1 equipped according to the invention. The operating mode, simplified according to the invention, for dismounting the main jib 21 from the telescopic crane 40 with a view to reducing the axial load of the latter has the following work steps.

In FIG. 5*a,* the partly telescoped main jib 21 is pivoted to the left and deposited on the semitrailer 1. Partly telescoped means, in this embodiment, that, for example, the telescopic section 48 has been moved out of the basic jib 23 until the roller head 49 can be deposited on the semitrailer receiving part 16 (FIGS. 1*a* and 1*b*). As already mentioned, for adjustment, the receiving part 16 can be displaced transversely and angularly adjusted. The two locking points, namely on the footpiece 50 of the basic jib 23 and on the hook 51, are released. In the first phase of retraction, the rear part of the basic jib 23 is moved along a fixed guide arranged on the superstructure 45. Referring to FIGS. 4*a* and 4*b,* for this purpose, a roller 53, 53' is in each case arranged on the right and left in the end region of the basic jib 23, said rollers being capable of rolling along a rail 54, 54' fastened to the superstructure 45.

FIG. 5*b* shows a phase in which the basic jib 23 has already been retracted a little way to the left. In this case, the rollers 22, 22' (FIGS. 2*a* and 2*b*) arranged on the basic jib 23 come into contact with the runway 26, 26' of the pivotable element 9, 9'. Since the first portion 14, 14' (FIGS. 1*a* and 1*b*) of the pivotable element 9, 9' runs obliquely upward, the basic jib 23 is lifted out of the superstructure 45.

Figure 5D:
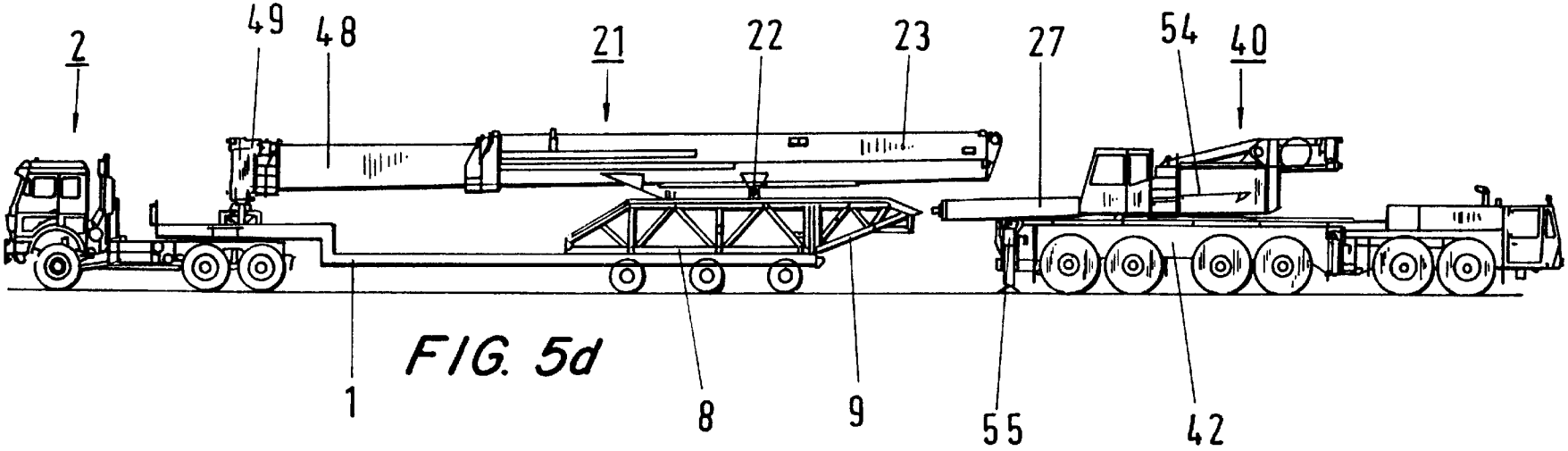
FIG. 5*d* shows a phase of dismounting the main jib from the telescopic crane wherein the semitrailer is moved to the left to avoid the foot region of the basic jib colliding with the luffing cylinder.

FIG. 5*c* shows the further retraction of the basic jib 23, until the rollers 22, 22' have reached approximately the first third of the horizontal portion 11, 11' of the fixed element 8, 8'. In order to prevent the foot region of the basic jib 23 from colliding with the luffing cylinder 27, the semitrailer must be moved to the left as depicted in FIG. 5*d*.

Figure 5E:
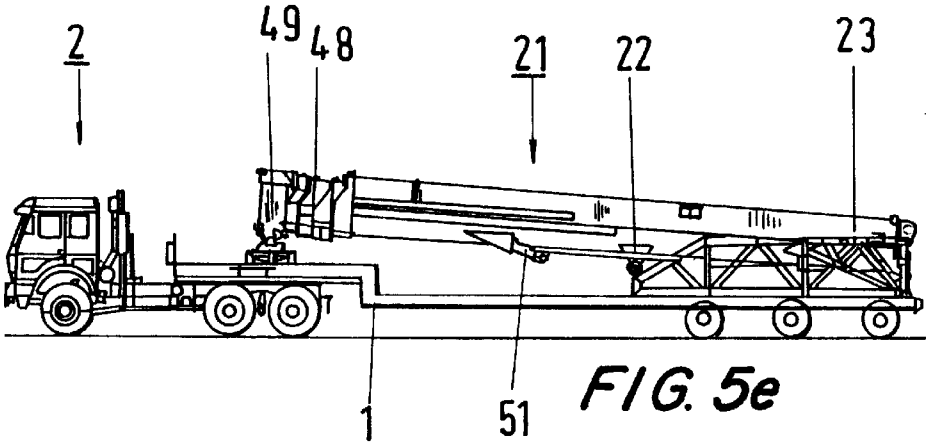
FIG. 5*e* shows a last phase of dismounting where the semitrailer is driven away from the telescopic crane which is relieved of the weight of the main jib.

FIG. 5*e* shows the semitrailer is driven away from the telescopic crane 40 which is relieved of the weight of the main jib 21. In order to bring the main jib 21 into the transport position, the basic jib 23 is retracted even further, so that the rollers 22, 22' slide downward along the oblique portion 12, 12' (FIGS. 1*a* and 1*b*) of the fixed element 8, 8'. In this case, the clear distance 52 between the two beams 6, 6' is selected so that the main jib 21 can be deposited between them. As illustrated in FIG. 1*b*, the outwardly projecting pivotable elements 9, 9' of the beam 6, 6' which obstruct transport are folded parallel to the fixed element 8, 8'.

While there have shown and described and pointed out fundamental novel features of the invention as applied to several preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

I claim:

1. An apparatus for reducing the axle load of a multiaxle movable crane, consisting essentially of:

a truck;

a superstructure rotatably mounted on the truck;

a main jib releasably fastened to the superstructure and including a basic jib, at least one telescopic section, and a pair of rollers fastened to the basic jib, the basic jib having a sidewall and an end region;

a semitrailer having a front end, a back end with a loading area, a first ramp-shaped beam and a second ramp-shaped beam arranged in a longitudinal direction of the semitrailer in the loading area so as to be parallel to and at a distance from one another and to form a longitudinally extending ramp, each ramp-shaped beam having a top edge and a contoured runway disposed along the top edge, said rollers being configured to engage the contour of the runway and operable to transport the main jib from the superstructure directly to the semitrailer, the semitrailer further having a saddle, and a receiving part disposed on said saddle so as to be angularly movable and laterally displaceable so as to receive a roller head of the main jib for transporting the main jib from the truck to the semitrailer;

a pair of web plates angled in a transverse direction of the basic jib and fastened to the sidewall, the rollers being mounted to the web plates; and additional rollers arranged in the end region on each side of the basic jib, said superstructure having rails arranged thereon, wherein said rollers and said rails form a guide for transport of the main jib.

2. The apparatus according to claim 1, wherein each said ramp-shaped beam has a fixed element and a movable element, the movable element being connected to the fixed element so as to be movable between a position in which the movable element extends from the fixed element and a position in which the movable element is substantially parallel to the fixed element.

3. The apparatus according to claim 2, wherein the fixed element has a horizontal portion which extends toward the front end of the semitrailer from a point of connection with the movable element, and an obliquely descending portion at a front end of the horizontal portion.

4. The apparatus according to claim 2, wherein the movable element comprises a horizontal portion which extends from a point of connection with fixed stationary element toward the truck when the truck is positioned in front of the semitrailer, and a portion at a front end of the horizontal portion which obliquely descends in the direction of the truck.

5. The apparatus according to claim 4, wherein the obliquely descending portion of the movable element further comprises a lower edge portion and a guide part including two struts and the truck comprising a top edge for resting against the lower edge portion and a receiving part at a bumper region for receiving the guide part.

6. The apparatus according to claim 2, wherein the fixed element comprises a hinge for pivotably moving the movable element.

7. The apparatus according to claim 6, wherein the movable element is positionable in front of the multiaxle movable crane so as to extend, starting from a pivoting point with the fixed element, toward the multiaxle movable crane, the movable element having a horizontal portion including an obliquely descending portion.

8. The apparatus according to claim 7, wherein a guide part including two struts is arranged on the obliquely descending portion and the truck has a top edge and a truck receiving part comprising two forks, wherein the movable element comes to bear on the top edge of the truck and the struts engage the two forks of the truck receiving part.

9. The apparatus according to claim 2, wherein the movable element is displaceable in a longitudinal direction parallel to the fixed element.

10. The apparatus according to claim 1, wherein each said runway has an upwardly directed U-shaped profile.

11. The apparatus according to claim 1, wherein the truck has a top edge and a truck receiving part and each ramp-shaped beam of the semitrailer has a movable element having a lower edge region, the lower edge region having an obliquely descending portion abuting the top edge of the truck, the obliquely descending portion having a plurality of struts arranged on it to engage the truck receiving part.

12. The apparatus as in claim 11 wherein the truck receiving part comprises two forks.

* * * * *